US009943115B2

(12) United States Patent
Liu

(10) Patent No.: US 9,943,115 B2
(45) Date of Patent: Apr. 17, 2018

(54) ELECTRONIC CIGARETTE AND ELECTRONIC CIGARETTE-BASED CONTROL METHOD

(71) Applicant: HUIZHOU KIMREE TECHNOLOGY CO., LTD. SHENZHEN BRANCH, Shenzhen, Guangdong (CN)

(72) Inventor: Qiuming Liu, Guangdong (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 0 days.

(21) Appl. No.: 15/332,158

(22) Filed: Oct. 24, 2016

(65) Prior Publication Data

US 2017/0095004 A1 Apr. 6, 2017

Related U.S. Application Data

(63) Continuation of application No. PCT/CN2014/080190, filed on Jun. 18, 2014.

(30) Foreign Application Priority Data

Apr. 24, 2014 (CN) ..... 2014 2 0204130 U

(51) Int. Cl.
*A24F 47/00* (2006.01)
*H05B 1/02* (2006.01)

(52) U.S. Cl.
CPC ..... *A24F 47/008* (2013.01); *H05B 1/0244* (2013.01)

(58) Field of Classification Search
CPC ..... A24F 47/008; H05B 1/0244; H05B 3/04; H05B 2203/021; H05B 2203/022;
(Continued)

(56) References Cited

U.S. PATENT DOCUMENTS

2013/0284192 A1* 10/2013 Peleg ..... A24F 47/002 131/329
2016/0057811 A1* 2/2016 Alarcon ..... A24F 47/008 219/494

(Continued)

FOREIGN PATENT DOCUMENTS

CN 203378558 U 1/2014
CN 203467667 U 3/2014

(Continued)

OTHER PUBLICATIONS

International Search Report for PCT/CN2014/080190 , dated Jan. 26, 2015, ISA/CN.

*Primary Examiner* — Edwin A. Leon
(74) *Attorney, Agent, or Firm* — U.S. Fairsky LLP; Yue Xu

(57) ABSTRACT

An electronic cigarette and an electronic cigarette-based control method are provided. The electronic cigarette includes an electronic cigarette body, which is provided with multiple atomizers, a battery, a smoking switch, an input module and a microprocessor electrically connected to the input module, the smoking switch, the battery and the atomizers. Multiple electromagnetic switches are electrically connected to the microprocessor, which are arranged opposite air intake holes of the atomizers one to one and used for opening or closing corresponding air intake holes. According to a trigger signal, the microprocessor enables the battery to power a target atomizer and a target electromagnetic switch to prevent an airflow from flowing through atomizers not operating, making the airflow only flow into the target atomizer, thereby increasing air into the target atomizer, the amount of vapor to be atomized and the concentration of smoke.

21 Claims, 14 Drawing Sheets

(58) Field of Classification Search
CPC ..... H02J 7/0052; H04N 5/374; G06K 9/6215; G06K 9/325; G06K 9/3241
USPC ..... 131/328–329
See application file for complete search history.

(56) References Cited

U.S. PATENT DOCUMENTS

| | | | | |
|---|---|---|---|---|
| 2016/0261021 | A1* | 9/2016 | Marion | A24F 47/008 |
| 2017/0046738 | A1* | 2/2017 | Cameron | G06Q 30/0255 |

FOREIGN PATENT DOCUMENTS

| | | | |
|---|---|---|---|
| CN | 103783672 | A | 5/2014 |
| CN | 103783673 | A | 5/2014 |
| WO | 2012065310 | A1 | 5/2012 |

* cited by examiner

ELECTRONIC CIGARETTE AND ELECTRONIC CIGARETTE-BASED CONTROL METHOD

CROSS REFERENCE TO RELATED APPLICATION

The application is a continuation application of International Application No. PCT/CN2014/080190, titled "ELECTRONIC CIGARETTE AND ELECTRONIC CIGARETTE-BASED CONTROL METHOD", and filed on Jun. 18, 2014, which claims priority to Chinese patent application No. 201420204130.2, titled "ELECTRONIC CIGARETTE" and filed with the State Intellectual Property Office of the People's Republic of China on Apr. 24, 2014, which is hereby incorporated by reference in its entirety.

FIELD

The present disclosure relates to the field of electronic cigarette, and particularly to an electronic cigarette capable of atomizing cigarette liquids with different flavors and increasing the amount of smoke, and a control method based on the electronic cigarette.

BACKGROUND

In conventional technology, an electronic cigarette includes an atomizer in which cigarette liquid is stored. When an action of a user smoking the electronic cigarette is sensed, the electronic cigarette controls a battery of the electronic cigarette to supply power to the atomizer, for a heating wire inside the atomizer to atomize the cigarette liquid inside the atomizer.

The atomizer in conventional technology is capable of storing only a limited amount of cigarette liquid with only a single flavor. Therefore, if the user wants to smoke cigarette liquids with different flavors, multiple electronic cigarettes are needed, which causes inconvenience to the user. In conventional technology, there also exists an electronic cigarette provided with multiple atomizers. When the user begins to smoke the electronic cigarette, an airflow is formed inside the electronic cigarette, which flows through each of the atomizers to drive smoke to a mouthpiece, thus the smoke can be inhaled by the user through the mouthpiece. However, if only some of the atomizers operate and the others do not operate, the airflow inside the body of the electronic cigarette will flow into the atomizers which operate as well as the atomizers which do not operate, and the airflow flows into the atomizers which do not operate will not drive the smoke, which causes a waste of the airflow, reducing the amount of air flowing into the atomizers which operate and thereby reducing the amount of smoke atomized by the atomizer. Further, the airflow inhaled by the user contains an airflow carrying the smoke as well as an airflow which does not carry smoke, thereby reducing the concentration of the smoke in the airflow inhaled by the user, thus smoking experience of the user is reduced.

SUMMARY

In view of this, an electronic cigarette which can atomize cigarette liquids with different flavors and increase the amount of smoke, and a control method based on the electronic cigarette are provided according to the present disclosure.

An electronic cigarette is provided, where the electronic cigarette includes:

an electronic cigarette body;

multiple atomizers configured to atomize cigarette liquid, a battery configured to supply power to the multiple atomizers, a smoking switch configured to generate a trigger signal according to an operation of a user, an input module configured to receive a first operation instruction from the user to select a target atomizer, and a microprocessor electronically connected to the input module, the smoking switch, the battery and the multiple atomizers, all of which are arranged inside the electric cigarette body; and multiple electromagnetic switches electronically connected to the microprocessor, where the multiple electromagnetic switches are arranged in a one-to-one correspondence relationship with air intake holes of the multiple atomizers and are configured to open or close respective air intake holes, for the microprocessor to control the battery to supply power to the target atomizer and a target electromagnetic switch corresponding to the target atomizer according to the trigger signal, to enable a target air intake hole of the target atomizer to communicate with an air inlet on the electronic cigarette body.

In the above electronic cigarette, each of the multiple electromagnetic switches includes:

a fixing sleeve;

a first through hole provided at an end of the fixing sleeve close to an atomizer;

an end cover provided at and matching with an end of the fixing sleeve away from the atomizer;

a movable rod provided inside the fixing sleeve and extended towards the atomizer through the first through hole to form an abutting-against portion, where the abutting-against portion is arranged opposite to and abutting against an air intake hole of the atomizer;

a movable iron core provided inside an end of the movable rod away from the atomizer;

a helical first magnetic coil wound around an outer circumference of the fixing sleeve, where the first magnetic coil, when powered on, generates an electromagnetic force to attract the movable iron core, to enable the air intake hole to communicate with the air inlet;

a retaining ring formed by a circumferential side of the movable rod close to the first through hole extending in a radial direction of the movable rod, where a diameter of the retaining ring is greater than a diameter of the first through hole; and a returning elastic member provided around the movable rod and retained between the retaining ring and the end cover, where the returning elastic member controls the abutting-against portion to abut against the air intake hole when the first magnetic coil is powered off.

In the above electronic cigarette, the returning elastic member is a returning spring.

In the above electronic cigarette, each of the electromagnetic switches includes:

a magnetic core; and a second magnetic coil wound around an outer circumference of the magnetic core, where the second magnetic coil, when powered on, generates an electromagnetic force for moving away from the atomizer.

In the electronic cigarette, fixation bases detachably connected to the multiple atomizers respectively are provided;

second through holes corresponding to the air intake holes of the multiple atomizers in position are provided on the fixation bases;

a first check valve is fixedly provided inside each of the second through holes;

a first iron sheet is provided on a valve gate of the first check valve, where the first iron sheet abuts against an air intake hole of a corresponding atomizer under the action of an airflow inside the electronic cigarette body when the second magnetic coil is powered off, and the first iron sheet is attracted by the electromagnetic force generated by the second magnetic coil and moves away from the target air intake hole when the second magnetic coil is powered on, to enable the target air intake hole to communicate with the air inlet.

In the above electronic cigarette, a second check valve is provided matching with each of the air intake holes of the multiple atomizers; and a second iron sheet is provided on a valve gate of the second check valve, where the second iron sheet abuts against an air intake hole of a corresponding atomizer under the action of an airflow inside the electronic cigarette body when the second magnetic coil is powered off, and the second iron sheet is attracted by the electromagnetic force generated by the second magnetic coil and moves away from the target air intake hole when the second magnetic coil is powered on, to enable the target air intake hole to communicate with the air inlet.

The above electronic cigarette may further include:

a mounting base, where the multiple atomizers are removably inserted in the mounting base for the multiple atomizers to be detachably connected to the electronic cigarette body.

In the above electronic cigarette, each of the atomizers includes:

an atomizing sleeve;

an electric heating assembly provided inside the atomizing sleeve and configured to atomize cigarette liquid;

a cigarette liquid storage assembly provided inside the atomizing sleeve and configured to store the cigarette liquid and deliver the cigarette liquid to the electric heating assembly;

an external electrode inserted in the atomizing sleeve;

an insulating ring sleeved inside the external electrode; and an internal electrode inserted in the insulating ring, where the air intake hole is arranged on the internal electrode.

In the above electronic cigarette, the smoking switch is an airflow-sensitive switch configured to generate the trigger signal according to a smoking action of the user.

In the above electronic cigarette, the input module includes:

a second operation button configured to generate the first operation instruction according to a pressing operation of the user; and/or a touch screen configured to generate the first operation instruction according to a touch operation of the user; and/or a voice smoking switch configured to generate the first operation instruction according to a voice inputted by the user.

A control method based on the electronic cigarette according to any of the above is provided, which includes:

selecting, by the input module, at least one of the multiple atomizers as the target atomizer according to the first operation instruction inputted by the user;

determining, by the microprocessor, the target atomizer according to the first operation instruction;

generating, by the smoking switch, the trigger signal according to an operation of the user;

controlling, by the microprocessor, the battery to supply power to the target atomizer and the target electromagnetic switch according to the trigger signal;

atomizing, by the target atomizer, the cigarette liquid stored inside the target atomizer to generate smoke;

generating, by the target electromagnetic switch which is powered on, an electromagnetic force for moving away from the target atomizer; and controlling, by the target electromagnetic switch by means of the electromagnetic force, the target air intake hole to communicate with the air inlet.

In the above method, the generating, by the target electromagnetic switch which is powered on, an electromagnetic force for moving away from the target atomizer includes generating, by the first magnetic coil of the target electromagnetic switch which is powered on, the electromagnetic force; and the controlling, by the target electromagnetic switch by means of the electromagnetic force, the target air intake hole to communicate with the air inlet includes: attracting the movable iron core inside the movable rod by the electromagnetic force generated by the first magnetic coil, the movable rod containing the movable iron core moving away from the target atomizer, to enable the target air intake hole to communicate with the air inlet, and compressing, by the movable rod moving away from the target atomizer, the returning elastic member, to render the returning elastic member in a compressed state.

After the compressing, by the movable rod moving away from the target atomizer, the returning elastic member, the control method further includes:

receiving, by the input module, a second operation instruction inputted by the user for controlling the target atomizer to stop operation; and controlling, by the microprocessor, the target atomizer and the first magnetic coil to be powered off according to the second operation instruction, for the returning elastic member in the compressed state to spring back to control the movable rod to return to its original position, to enable the abutting-against portion to abut against the air intake hole again.

In the above method, the generating, by the target electromagnetic switch which is powered on, an electromagnetic force for moving away from the target atomizer includes generating, by the second magnetic coil of the target atomizer which is powered on, the electromagnetic force; and the controlling, by the target electromagnetic switch by means of the electromagnetic force, the target air intake hole to communicate with the air inlet includes: attracting the first iron sheet by the electromagnetic force generated by the second magnetic coil, and the first iron sheet moving away from the target air intake hole for the target air intake hole to communicate with the air inlet.

After the first iron sheet moving away from the target air intake hole, the control method further includes:

receiving, by the input module, the second operation instruction inputted by the user; and controlling, by the microprocessor according to the second operation instruction, the target atomizer and the second magnetic coil to be powered off, for the first iron sheet to abut against the air intake hole again under the action of an airflow inside the electronic cigarette body.

In the control method, the generating, by the target electromagnetic switch which is powered on, an electromagnetic force for moving away from the target atomizer may include generating, by the second magnetic coil which is powered on, the electromagnetic force; and the controlling, by the target electromagnetic switch by means of the electromagnetic force, the target air intake hole to communicate with the air inlet includes attracting the second iron sheet by the electromagnetic force generated by the second magnetic coil, and the second iron sheet moving away from the target air intake hole for the target air intake hole to communicate with the air inlet.

After the second iron sheet moving away from the target air intake hole, the control method further includes:

receiving, by the input module, the second operation instruction; and controlling, by the microprocessor according to the second operation instruction, the target atomizer and the second magnetic coil to be powered off, for the second iron sheet to abut against the air intake hole of the atomizer again under the action of an airflow inside the electronic cigarette body.

The electronic cigarette according to the present disclosure includes: an electronic cigarette body; multiple atomizers, a battery, a smoking switch, an input module, and a microprocessor electronically connected to the input module, the smoking switch, the battery and the atomizers, all of which are arranged inside the electric cigarette body; and multiple electromagnetic switches electronically connected to the microprocessor, where the multiple electromagnetic switches are arranged in a one-to-one correspondence relationship with air intake holes of the multiple atomizers and are configured to open or close respective air intake holes. With the electronic cigarette according to the present disclosure, the microprocessor is enabled to control the battery to supply power to at least one target atomizer, so that multiple atomizers can operate. In addition, the microprocessor may control the battery to supply power to the target electromagnetic switch corresponding to the target atomizer according to the trigger signal, so that the airflow inside the electronic cigarette body does not flow through atomizers which do not operate but only flows through the target atomizer, thereby increasing the airflow into the target atomizer and increasing the amount of the smoke atomized by the atomizer, thus the concentration of the smoke inhaled by the user can be increased, and smoking experience of the user can be improved.

BRIEF DESCRIPTION OF THE DRAWINGS

To illustrate technical solutions according to embodiments of the present disclosure or in conventional technology more clearly, the drawings to be used in description of the embodiments or conventional technology are briefly described hereinafter. Apparently, the drawings only illustrate some embodiments of the invention, and other drawings may be obtained by those skilled in the art based on these drawings without any creative efforts.

DETAILED DESCRIPTION OF THE EMBODIMENTS

In a first embodiment, a specific structure of an electronic cigarette according to the present disclosure is described in detail. The structure of the electronic cigarette is shown in FIG. 1.

Figure 1:
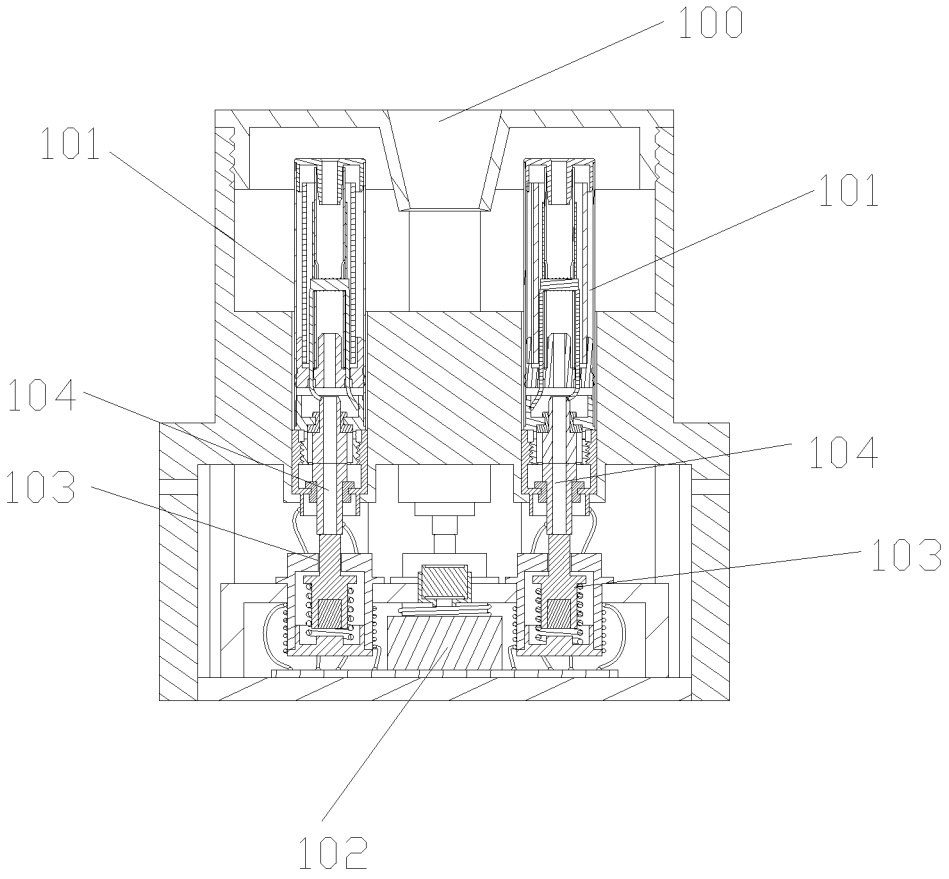
FIG. 1 is a schematic sectional view of the whole structure of an electronic cigarette which is not powered on according to a preferred embodiment of the invention.

Reference is made to FIG. 1, which is a schematic sectional view of the whole structure of the electronic cigarette which is not powered on according to the present disclosure.

The electronic cigarette includes:

an electronic cigarette body; and a mouthpiece cover 100 provided at a top end of the electronic cigarette body.

A mouthpiece or a straw which matches with a user mouth shape is detachably connected to the mouthpiece cover 100, so that the user can inhale smoke through the mouthpiece or the straw. Practically, the user may also inhale the smoke through the mouthpiece cover 100 directly, which is not limited in this embodiment.

The electronic cigarette body is provided with multiple atomizers 101 configured to atomize cigarette liquids.

According to the sectional view of the whole structure of the electronic cigarette shown in FIG. 1, two atomizers 101 are provided. It should be clarified that multiple atomizers 101 can be provided inside the electronic cigarette body, the specific number of which is not limited in this embodiment.

In this embodiment, cigarette liquids are respectively stored inside the multiple atomizers 101, where different atomizers may store cigarette liquids with different flavors or cigarette liquid with one flavor. In this embodiment, in order for the user to taste cigarette liquids with different flavors, cigarette liquids with different flavors are stored inside the multiple atomizers 101, preferably.

Specifically, how the cigarette liquids are stored in respective atomizers 101 is not limited. For example, liquid storage cotton for storing cigarette liquid may be provided inside each atomizer 101, or a liquid storage bottle may be connected to each atomizer 101, so that the cigarette liquid stored inside the liquid storage bottle can be delivered to the atomizer 101 from the liquid storage bottle.

The electronic cigarette also includes:

a battery 102 configured to supply power to the multiple atomizers 101, a smoking switch configured to generate a trigger signal according to an operation of a user, and an input module configured to receive a first operation instruction from the user to select a target atomizer.

When the user determines an atomizer storing cigarette liquid with a flavor that the user wants to smoke to be the target atomizer, and wants the target atomizer to operate to generate smoke with a corresponding flavor, the input module can receive the first operation instruction from the user for selecting the target atomizer.

The electronic cigarette also includes a microprocessor electronically connected to the input module, the smoking switch, the battery and the multiple atomizers.

Specifically, the microprocessor may be a CPU or a microcontroller.

The microprocessor can determine the target atomizer which is required to operate according to the first operation instruction received by the input module, where one or more atomizers 101 may be selected as the target atomizer by the user.

The microprocessor controls the battery 102 to supply power to the target atomizer when detecting that the microprocessor itself receives the trigger signal inputted by the smoking switch In order to facilitate cigarette tasting of the user for the user to inhale smokes with different flavors, in this embodiment, multiple target atomizers are selected by the input module according to the first operation instruction inputted by the user.

On detection of the trigger signal, the microprocessor controls the battery 102 to supply power to atomizers determined to be the multiple target atomizers, to enable the multiple target atomizers to operate to atomize cigarette liquids.

With the electronic cigarette according to this embodiment, the user can simultaneously select the multiple target atomizers containing cigarette liquids with different flavors, for the multiple target atomizers to operate simultaneously, so that the user can inhale smokes with different flavors simultaneously.

The microprocessor may also control the multiple target atomizers to atomize the cigarette liquids sequentially, so that the user can inhale smokes with different flavors sequentially, thereby facilitating cigarette tasting of the user.

The microprocessor may also control the multiple target atomizers to atomize the cigarette liquids randomly, so that the user can inhale smokes with different flavors randomly, thereby making the smoking process more interesting for the user.

The sequence in which the microprocessor controls the multiple target atomizers to atomize the cigarette liquids is not limited in this embodiment.

Whether the microprocessor controls the multiple target atomizers to operate simultaneously, sequentially or randomly may be set by a manufacturer at the factory, or may be set with a selection switch provided on the electronic cigarette body, where a specific operation sequence of the target atomizers can be controlled with the selection switch, which is not limited in this embodiment.

More preferably, with the electronic cigarette according to this embodiment, an airflow inside the electronic cigarette can be prevented from flowing though atomizers which do not operate, thereby avoiding a waste of the airflow and improving a concentration of the smoke.

With continued reference to FIG. 1, multiple electromagnetic switches 103 are electronically connected to the microprocessor.

The number of the multiple electromagnetic switches 103 is equal to the number of the multiple atomizers 101, and the multiple electromagnetic switches 103 are arranged in a one-to-one correspondence relationship with the multiple atomizers 101.

A smoke channel 104 for the airflow to flow through is provided inside each atomizer 101, so that the airflow can carry the smoke to the mouthpiece cover 100 to be inhaled by the user.

An air intake hole is provided at an end of the smoke channel 104 close to a corresponding electromagnetic switch 103, so that the airflow inside the electronic cigarette body can flow into the smoke channel 104 through the air intake hole.

Specifically, the multiple electromagnetic switches 103 are arranged in a one-to-one correspondence relationship with the air intake holes of the multiple atomizers 101, and are configured to open or close respective air intake holes.

In specific applications, the microprocessor controls the battery 102 to supply power to the target atomizer and a target electromagnetic switch corresponding to the target atomizer according to the trigger signal, for a target air intake hole on the target atomizer to communicate with an air inlet on the electronic cigarette body, so that the smoke channel 104 of the target atomizer can communicate with the air inlet, thereby enabling the airflow to flow into the smoke channel 104 inside the target atomizer smoothly through the target air intake hole.

In this embodiment, the air intake hole of the atomizer which does not operate does not communicate with the air inlet, so that the airflow will not flow into the smoke channel 104 inside the atomizer which does not operate, thereby avoiding a waste of the airflow efficiently and improving the concentration of the smoke.

According to this embodiment, the electronic cigarette may control multiple atomizers to operate according to the operation of the user, thereby enabling multiple atomizers to atomize cigarette liquids with different flavors, so that the user can inhale smokes with different flavors. Further, the electronic cigarette according to this embodiment can control the air intake hole of the target atomizer selected by the user to communicate with the air inlet on the electronic cigarette body, to enable the airflow to flow into the smoke channel inside the target atomizer and not to flow into atomizers which do not operate, thereby avoiding a waste of the airflow and ensuring the amount of the airflow into the target atomizer, thus the amount and concentration of the smoke atomized by the target atomizer can be ensured.

In a second embodiment, how the electronic cigarette controls the airflow to flow into only the target atomizer is described in detail.

Figure 2:
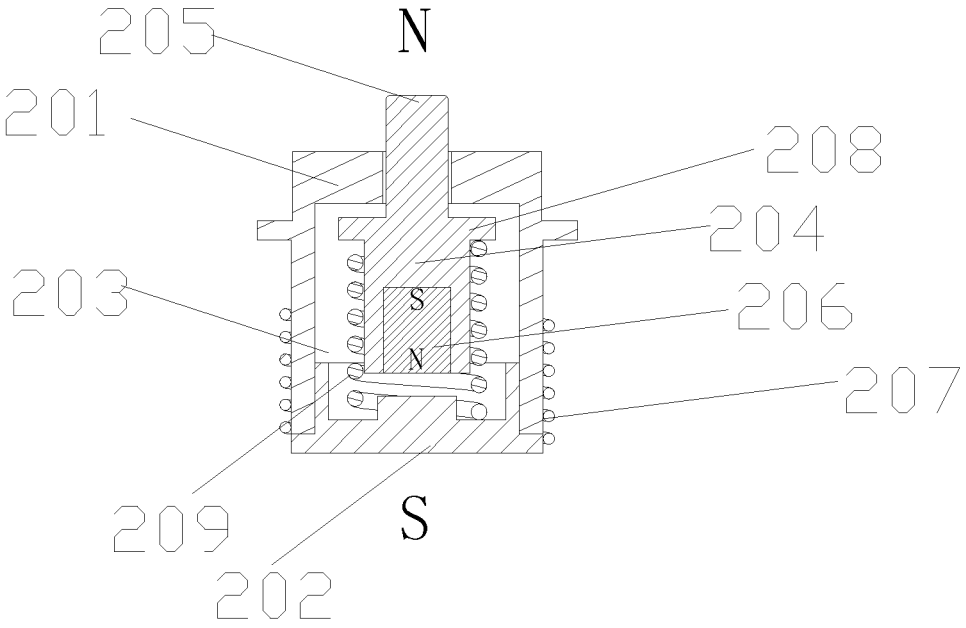
FIG. 2 is a schematic sectional view of the structure of an electromagnetic switch of an electronic cigarette according to a preferred embodiment of the invention.
Figure 3:
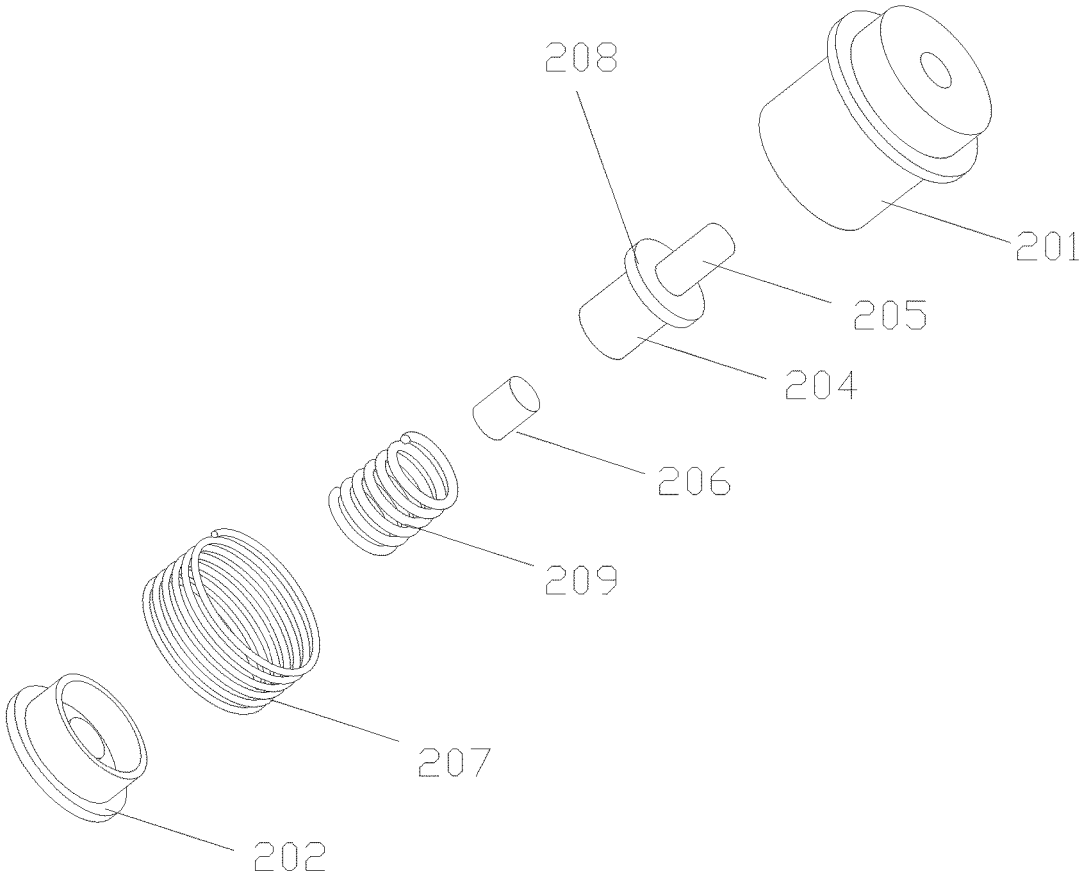
FIG. 3 is a schematic exploded view of the structure of an electromagnetic switch of an electronic cigarette according to a preferred embodiment of the invention.

A first configuration is shown in FIG. 2 and FIG. 3, the electromagnetic switch 103 includes:

a fixing sleeve 201.

A first through hole is provided at an end of the fixing sleeve 201 close to an atomizer 101.

An end cover 202 is provided at and matching with an end of the fixing sleeve 201 away from the atomizer 101.

The fixing sleeve 201 is arranged matching with the end cover 202 to form an accommodation space 203.

A movable rod 204 is provided inside the fixing sleeve 201.

Specifically, the movable rod 204 is inserted in the accommodation space 203.

Further, the movable rod 204 is extended towards the atomizer 101 through the first through hole to form an abutting-against portion 205.

The abutting-against portion 205 is arranged opposite to and abutting against an air intake hole of the atomizer 101.

A movable iron core 206 is provided inside an end of the movable rod 204 away from the atomizer 101.

A helical first magnetic coil 207 is wound around an outer circumference of the fixing sleeve 201.

On receiving the trigger signal, the microprocessor controls the battery 102 to supply power to the target atomizer and the first magnetic coil 207 of the target electromagnetic switch corresponding to the target atomizer, for the first magnetic coil 207 which is powered on to generate an electromagnetic force to attract the movable iron core 206, to enable the movable iron core 206 to move away from the atomizer under the electromagnetic force.

The powering on the magnetic coil to generate the electromagnetic force is a conventional technology, the electromagnetic principle of which is thus not described in this embodiment.

A retaining ring 208 is formed by a circumferential side of the movable rod 204 close to the first through hole extending in a radial direction of the movable rod 204.

A returning elastic member 209 is provided around the movable rod 204 and retained between the retaining ring 208 and the end cover 202, so that when the first magnetic coil 207 is powered off, the returning elastic member 209 generates an elastic force to restore to its original shape since it is no longer compressed by the retaining ring 208 and the end cover 202. The movable rod 204 moves towards the atomizer under the elastic force, so that the abutting-against portion 205 abuts against the air intake hole of the atomizer again.

Figure 4:
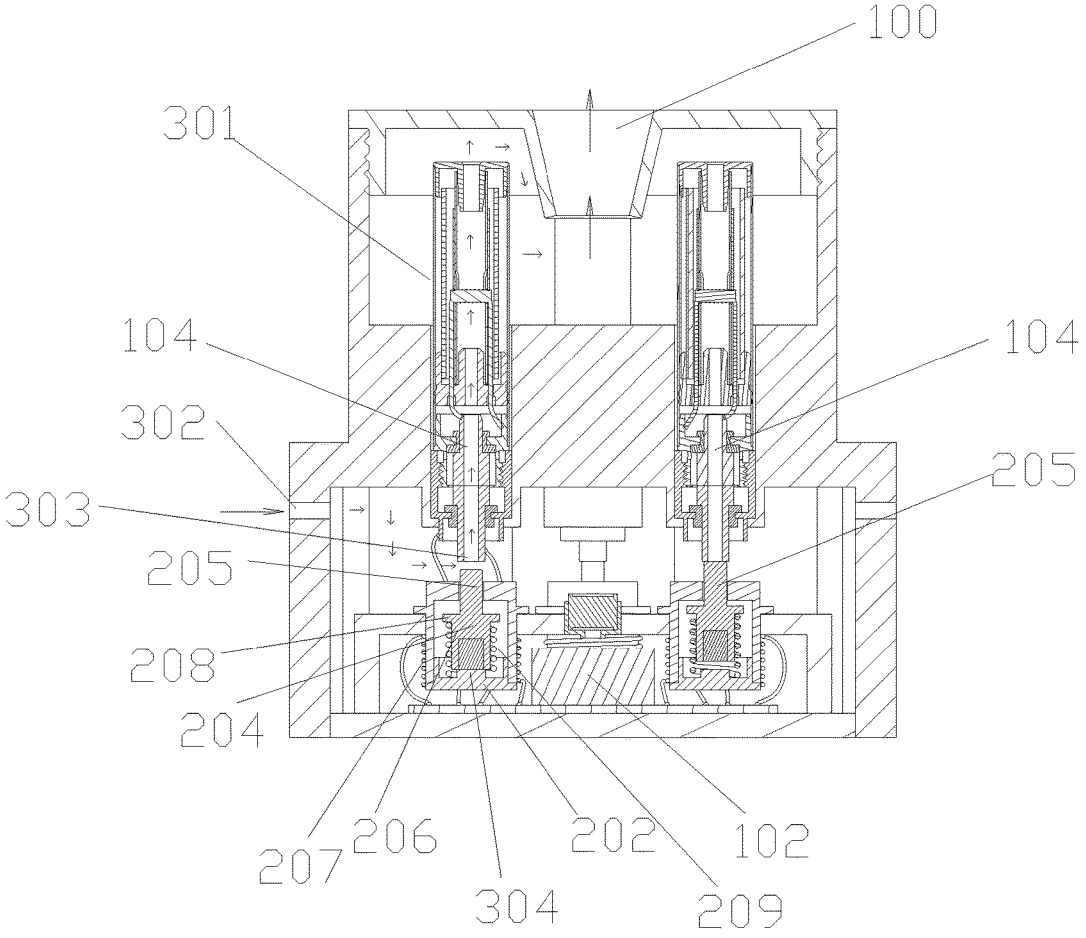
FIG. 4 is a schematic sectional view of the whole structure of an electronic cigarette which is powered on according to a preferred embodiment of the invention.

Particularly, a specific operation process of the electromagnetic switch 103 according to this embodiment is described in detail in conjunction with FIG. 4.

The input module receives a first operation instruction inputted by a user to select a target atomizer.

The smoking switch receives a trigger signal inputted by the user.

The microprocessor controls, according to the trigger signal, the battery 102 to supply power to the target atomizer 301 and the target electromagnetic switch 304 corresponding to the target atomizer 301 in position.

That is, the first magnetic coil 207 of the target electromagnetic switch 304 is powered on, and generates an electromagnetic force for moving away from the target atomizer 301.

The movable iron core 206 moves away from the target atomizer 301 under the electromagnetic force.

The movable iron core 206 moving away from the target atomizer 301 compresses the returning elastic member 209 between the retaining ring 208 and the end cover 202, so that the returning elastic member 209 undergoes resilient deformation.

Since the movable iron core 206 moves away from the target atomizer 301, the movable rod 204 containing the movable iron core 206 also moves away from the target atomizer 301, so that the abutting-against portion 205 of the movable rod 204 moves away from an air intake hole 303 of the target atomizer 301.

When the user smoke the electronic cigarette through the mouthpiece cover 100, a pressure inside the electronic cigarette body is reduced, and the airflow flows into the electronic cigarette body through the air inlet 302 on the electronic cigarette body.

Because of a gap between the air intake hole 303 of the smoke channel 104 of the target atomizer 301 and the abutting-against portion 205, the airflow can flow into the smoke channel 104 through the air intake hole 303, so that the airflow can carry the smoke inside the target atomizer 301 to the mouthpiece cover 100.

Specifically, the direction of the airflow is indicated by the arrow shown in FIG. 4.

The air intake hole of an atomizer which is not selected as the target atomizer by the user abuts against and is covered by the abutting-against portion 205, so that no gap exists between the air intake hole and the abutting-against portion 205, thus the airflow flowing into electronic cigarette body cannot flow into the atomizer through the air intake hole, thereby avoiding a waste of the airflow.

Preferably, since a diameter of the retaining ring 208 is greater than a diameter of the first through hole, when the movable rod 204 is sprung up by the returning elastic member 209 to abut against the air intake hole again, the movable rod 204 will not rush out of the accommodation space 203 formed by the fixing sleeve 201 and the end cover 202 under retaining of the retaining ring 208.

More preferably, the returning elastic member 209 is a returning spring.

Figure 5:
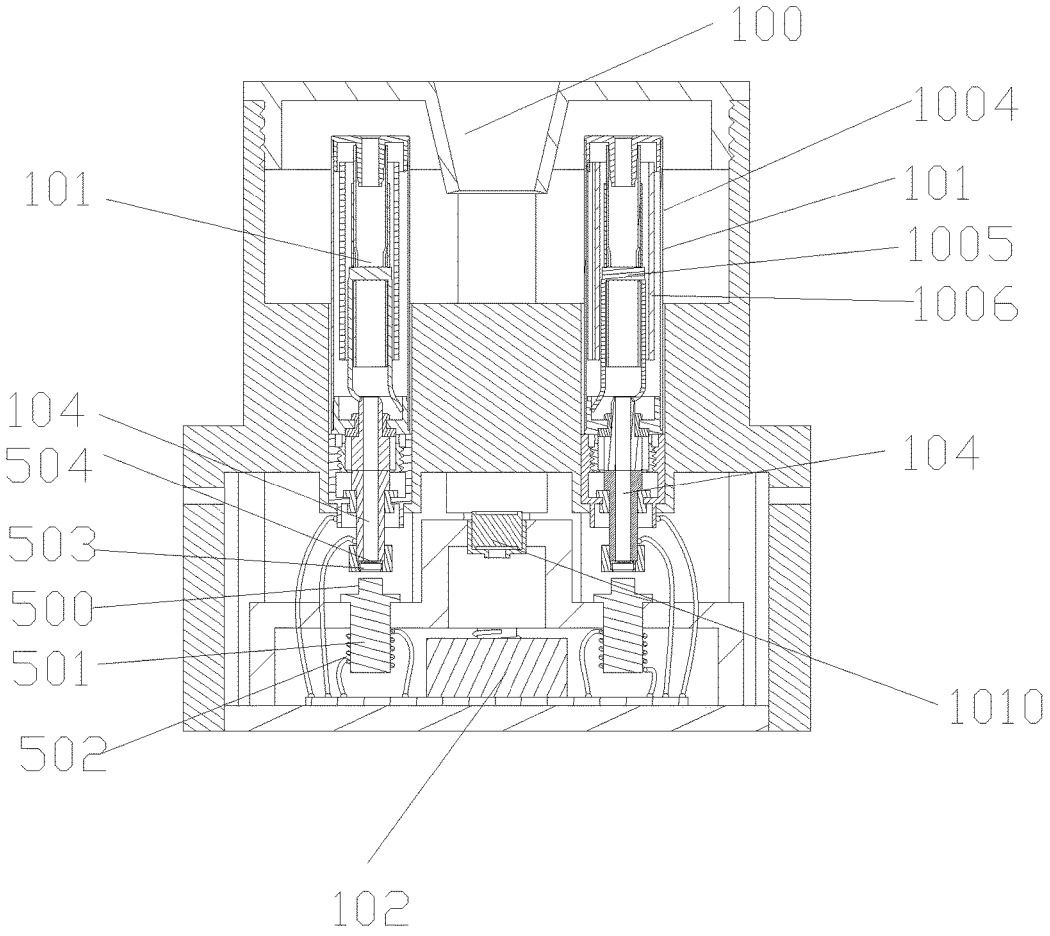
FIG. 5 is a schematic sectional view of the whole structure of an electronic cigarette which is not powered on according to another preferred embodiment of the invention.
Figure 6:
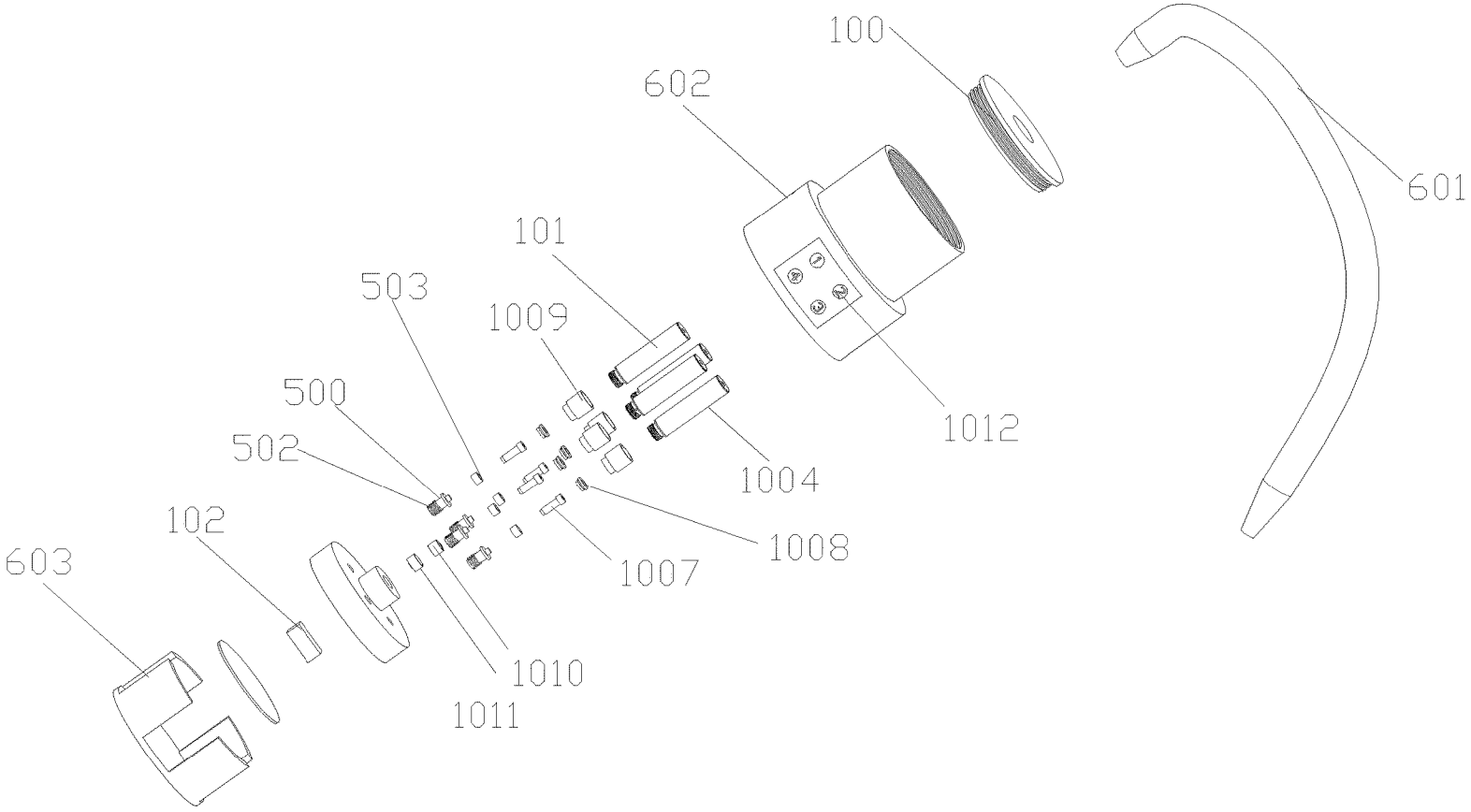
FIG. 6 is a schematic exploded view of the structure of an electronic cigarette according to a preferred embodiment of the invention.

A second configuration is shown in FIG. 5 and FIG. 6.

As can be seen from FIG. 5 and FIG. 6, the electronic cigarette includes a housing 602 and a bottom cover 603 matching with the housing 602, where the housing 602 and the bottom cover 602 are connected to form the electronic cigarette body.

A mouthpiece cover 100 is provided on the top of the housing 602. In this embodiment, a straw 601 is provided communicating with the mouthpiece cover 100, so that the user can inhale the smoke through the straw 601.

An atomizer 101 and a battery 102 are provided inside the electronic cigarette body, and a smoke channel 104 is provided inside the atomizer 101, for which reference can be made to the first embodiment, which is not described in this embodiment.

The electronic cigarette body further includes an electromagnetic switch 500 provided inside the electronic cigarette body.

The electromagnetic switch 500 includes:

a magnetic core 501; and a second magnetic coil 502 wound around an outer circumference of the magnetic core 501, where the second magnetic coil 502, when powered on, generates an electromagnetic force for moving away from the atomizer 101.

The powering on the second magnetic coil 502 to generate the electromagnetic force is a conventional electromagnetic induction technology, thus the detailed description is not described in this embodiment.

A fixation base 503 is detachably connected to the atomizer 101.

That is, the number of fixation bases 503 is equal to the number of atomizers 101, and the fixation bases 503 are arranged in a one-to-one correspondence relationship with the atomizers 101.

Since the atomizer 101 is detachably connected to the fixation base 503, the user can replace the atomizer 101 at any time, thereby facilitating the user to replace the atomizer.

A second through hole corresponding to an air intake hole of the atomizer in position is provided on the fixation base 503.

A first check valve 504 is fixedly provided inside the second through hole.

Figure 7:
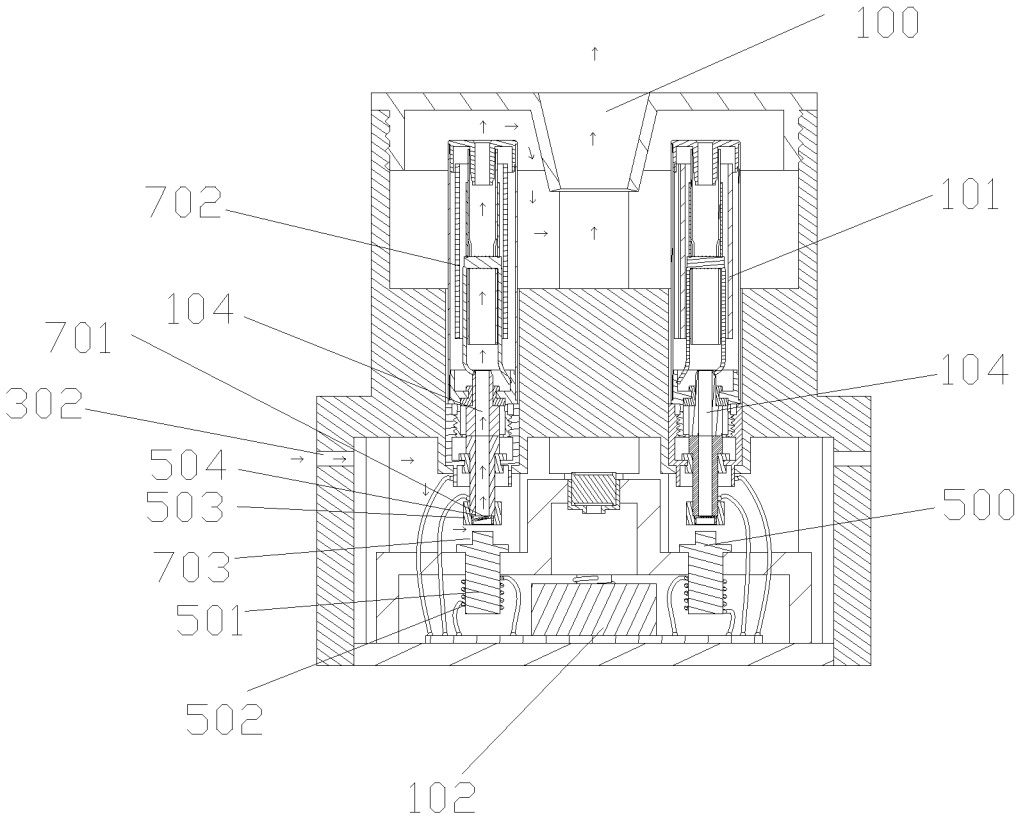
FIG. 7 is a schematic sectional view of the whole structure of an electronic cigarette which is powered on according to another preferred embodiment of the invention.

A first iron sheet 701 (as shown in FIG. 7) is provided on a valve gate of the first check valve 504, where the first iron sheet 701 opens when the second magnetic coil 502 is powered on for the airflow to flow into the smoke channel 104, and closes when the second magnetic coil 502 is powered off to prevent the airflow from flowing into the smoke channel 104.

How the microprocessor controls the airflow to flow only into the target atomizer is described in conjunction with FIG. 7 hereinafter.

The input module receives the first operation instruction inputted by the user to select a target atomizer 702.

The smoking switch receives a trigger signal inputted by a user.

The microprocessor controls, according to the trigger signal, the battery 102 to supply power to the target atomizer 702 and a target electromagnetic switch 703 corresponding to the target atomizer 702 in position.

That is, the second magnetic coil 502 of the target electromagnetic switch 703 is powered on, and generates the electromagnetic force for moving away from the target atomizer 702.

The target electromagnetic switch 703 attracts the first iron sheet 701 by means of the electromagnetic force, for the first iron sheet 701 to move away from a target air intake hole of the target atomizer 702 to form a gap between the first iron sheet 701 and the target air intake hole of the target atomizer for the airflow to flow into the smoke channel 104, that is, to enable the target air intake hole to communicate with the air inlet 302.

When the user smokes the electronic cigarette through the straw 601, a pressure inside the electronic cigarette body is reduced, and the airflow flows into the electronic cigarette body through the air inlet 302 on the electronic cigarette body.

Because of the gap between the target air intake hole of the target atomizer 301 and the first iron sheet 701, the airflow can flow into the smoke channel 104 through the target air intake hole, so that the airflow can carry the smoke inside the target atomizer 702 to the mouthpiece cover 100.

Specifically, the direction of the airflow in this configuration is indicated by the arrow shown in FIG. 7.

There is no gap between an air intake hole of an atomizer which is not selected as the target atomizer by the user and the first iron sheet 701, thus the airflow cannot flow into the smoke channel through the air intake hole, thereby avoiding a waste of the airflow.

In a case that the microprocessor controls the second magnetic coil 502 to be powered off, the first iron sheet 701 is no longer affected by the electromagnetic force away from the atomizer. In addition, under the action of the airflow inside the electronic cigarette, the first iron sheet 701 returns to the valve gate of the first check valve 504 to prevent the airflow from flowing in.

Since in this configuration, the first check valve 504 is provided on each of the fixation bases 503 and no change is made to the atomizer, a common atomizer may be adopted in the electronic cigarette.

Figure 8:
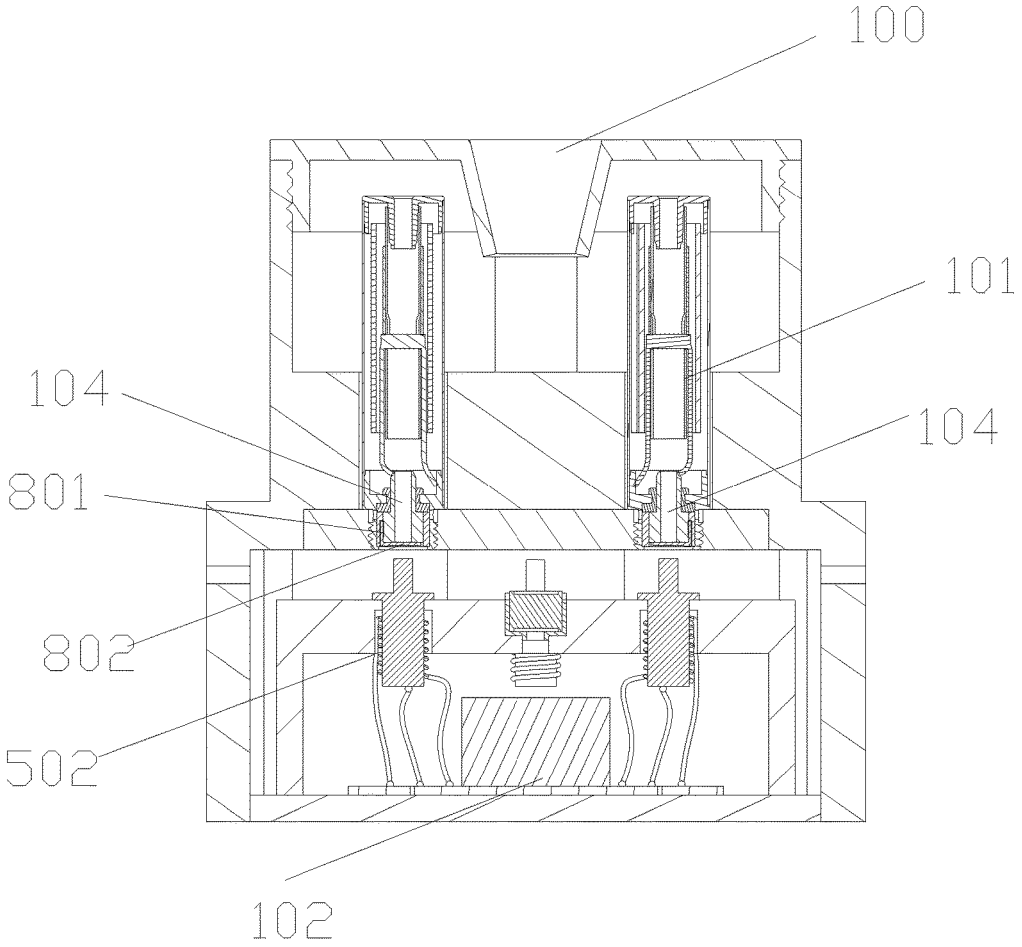
FIG. 8 is a schematic sectional view of the whole structure of an electronic cigarette which is not powered on according to another preferred embodiment of the invention.
Figure 9:
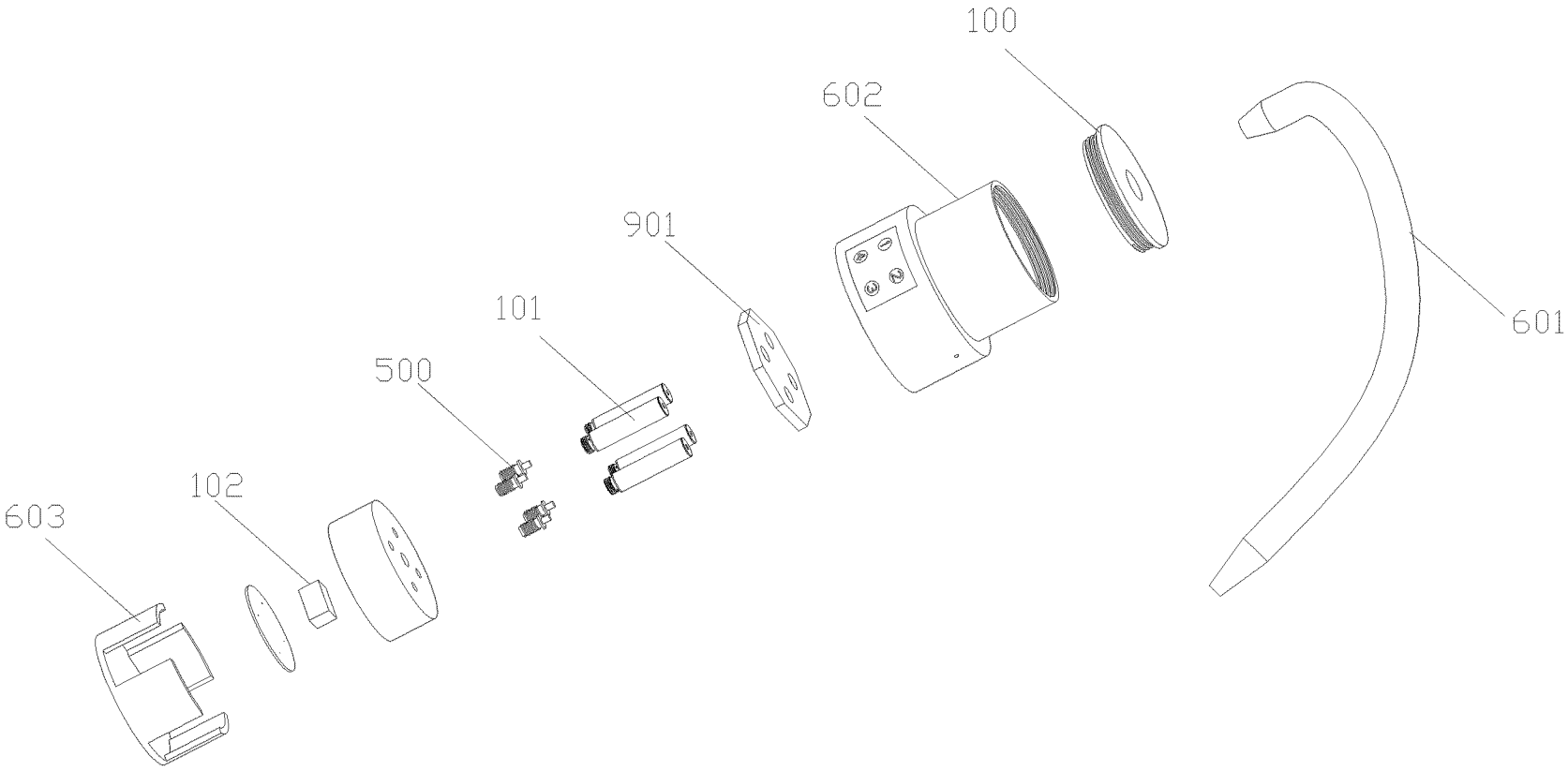
FIG. 9 is a schematic exploded view of the structure of an electronic cigarette according to another preferred embodiment of the invention.

A third configuration is shown in FIG. 8 and FIG. 9.

As can be seen from FIG. 8 and FIG. 9, the electronic cigarette includes a housing 602 and a bottom cover 603 matching with the housing 602, where the housing 602 and the bottom cover 602 are connected to form the electronic cigarette body.

A mouthpiece cover 100 is provided on the top of the housing 602. In this embodiment, a straw 601 is provided communicating with the mouthpiece cover 100, so that the user can inhale the smoke through the straw 601.

An atomizer 101 and a battery 102 are provided inside the electronic cigarette body, and a smoke channel 104 and the electromagnetic switch 500 are provided inside the atomizer 101, for which reference can be made to the second configuration, which is not described in this embodiment.

In this configuration, a second check valve 801 is provided matching with an air intake hole of the atomizer.

That is, the second check valve 801 is arranged inside the smoke channel 104 of the atomizer 101.

A second iron sheet 802 is provided on a valve gate of the second check valve 801.

The second iron sheet 802 opens when the second magnetic coil 502 is powered on for the airflow to flow into the smoke channel 104, and closes when the second magnetic coil 502 is powered off to prevent the airflow from flowing into the smoke channel 104.

How the microprocessor controls the airflow to flow only into the target atomizer is described in conjunction with FIG. 10 hereinafter.

The input module receives a first operation instruction inputted by a user to select a target atomizer 1002.

The smoking switch receives a trigger signal inputted by the user.

The microprocessor controls, according to the trigger signal, the battery 102 to supply power to the target atomizer 1002 and a target electromagnetic switch 1003 corresponding to the target atomizer 1002 in position.

That is, the second magnetic coil 502 of the target electromagnetic switch 1003 is powered on, and generates the electromagnetic force for moving away from the target atomizer 1002.

The target electromagnetic switch 1003 attracts the second iron sheet 802 by means of the electromagnetic force, for the first iron sheet 802 to move away from an target air intake hole of the target atomizer 1002 to form a gap between the second iron sheet 802 and the target air intake hole of the target atomizer 1002 for the airflow to flow into the smoke channel 104, that is, to enable the target air intake hole to communicate with the air inlet 302.

When the user smokes the electronic cigarette through the straw 601, a pressure inside the electronic cigarette body is reduced, and the airflow flows into the electronic cigarette body through the air inlet 302 on the electronic cigarette body.

Because of the gap between the target air intake hole of the target atomizer 1002 and the second iron sheet 802, the airflow can flow into the smoke channel 104 through the target air intake hole, so that the airflow can carry the smoke inside the target atomizer 1002 to the mouthpiece cover 100.

Figure 10:
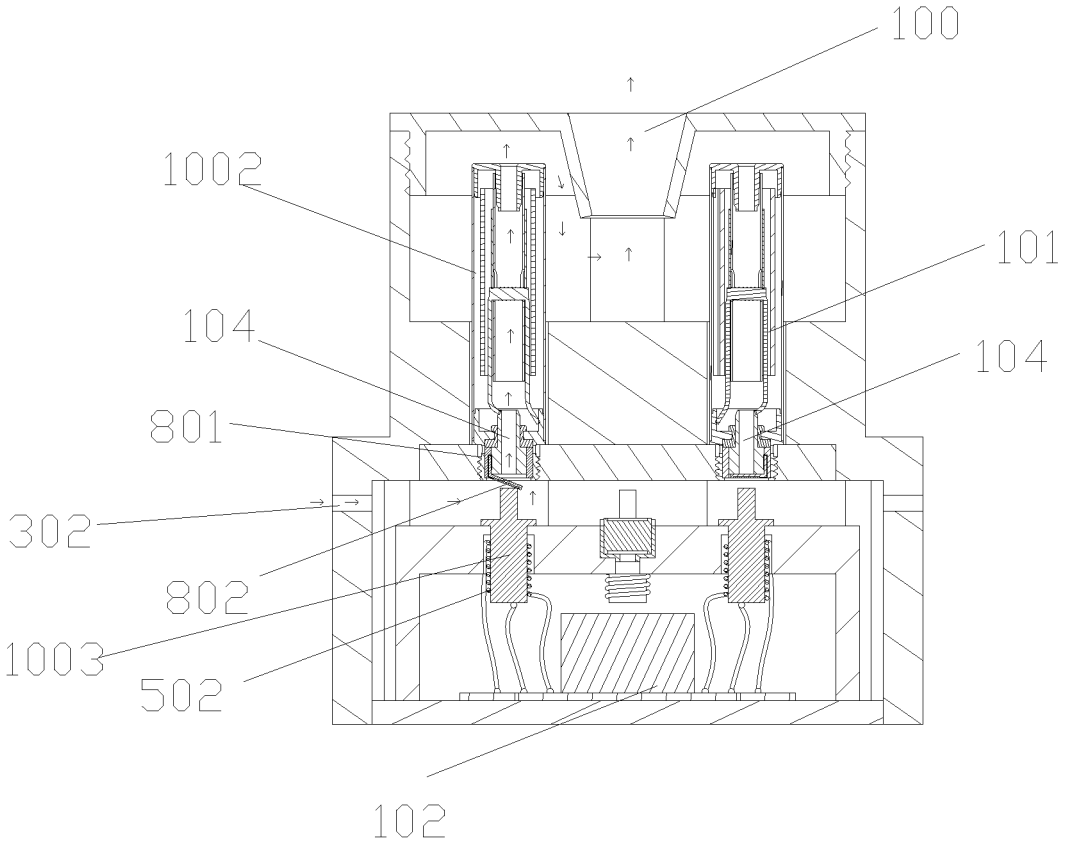
FIG. 10 is a schematic sectional view of the whole structure of an electronic cigarette which is powered on according to another preferred embodiment of the invention.

Specifically, the direction of the airflow in this configuration is indicated by the arrow shown in FIG. 10.

There is no gap between an air intake hole of an atomizer which is not selected as the target atomizer by the user and the second iron sheet 802, thus the airflow cannot flow into the smoke channel through the air intake hole, thereby avoiding a waste of the airflow.

In a case that the microprocessor controls the second magnetic coil 502 to be powered off, the second iron sheet 802 is no longer affected by the electromagnetic force for moving away from the atomizer. In addition, under the action of the airflow inside the electronic cigarette, the second iron sheet 802 returns to the valve gate of the second check valve 801 to prevent the airflow from flowing in.

In this embodiment, the second check valve is disposed inside the smoke channel of the atomizer, so that the second check valve can be more tightly connected to the atomizer, thereby further reducing the possibility of the airflow flowing into the smoke channel 104.

In a third embodiment, a specific structure of the electronic cigarette is described in further detail.

As shown in FIG. 9, the electronic cigarette may further include a mounting base 901.

With the mounting base 901, the multiple atomizers 101 can be removably inserted in the mounting base for the multiple atomizers 101 to be detachably connected to the electronic cigarette body. Therefore, the user can replace an atomizer 101 at any time as needed, thereby facilitating the user to replace a failed atomizer 101 or to add cigarette liquid into an atomizer 101.

The specific detachable connection may be the mounting base 901 being detachably connected to the atomizer 101 by means of a screw thread or a snap lock, which is not described in this embodiment.

In the following, a specific structure of the atomizer 101 is described in detail in conjunction with FIG. 5 and FIG. 6.

The atomizer 101 includes:

an atomizing sleeve 1004;

an electric heating assembly 1005 provided inside the atomizing sleeve 1004 and configured to atomize cigarette liquid; and a cigarette liquid storage assembly 1006 provided inside the atomizing sleeve 1004 and configured to store the cigarette liquid and deliver the cigarette liquid to the electric heating assembly 1005.

Specifically, in this embodiment, the specific structure of the electric heating assembly 1005 is not limited, as long as the electric heating assembly 1005 is capable of atomizing the cigarette liquid to generate smoke. For example, the electric heating assembly 1005 may be a heating wire wound around a cigarette liquid guiding wick, or a heating wire compressed into a sheet and wound into a helical shape or a serpentine shape.

The specific structure of the cigarette liquid storage assembly 1006 is not limited in this embodiment, as long as the cigarette liquid storage assembly 1006 is capable of storing the cigarette liquid and delivering the cigarette liquid to the electric heating assembly 1005. For example, the electric heating assembly 1005 may be a cigarette liquid storage cotton block, and the cigarette liquid guiding wick passes through the cigarette liquid storage cotton block. This configuration can prevent the cigarette liquid from flowing reversely, thereby avoiding leakage of the cigarette liquid.

The cigarette liquid storage assembly 1006 may also be a cigarette liquid storage chamber, a cigarette liquid guiding cloth is provided between the cigarette liquid storage chamber and the electric heating wire 1005 in a sheet form, so that the electric heating wire 1005 in a sheet form is helically arranged on the cigarette liquid guiding cloth, thereby effectively preventing the cigarette liquid storage cotton block from being burned by the electric heating wire 1005 in operation, and increasing a contact area of the electric heating assembly 1005 and the cigarette liquid storage assembly 1006, thus the amount of smoke can be increased.

With further reference to FIG. 6, the atomizer 101 further includes:

an external electrode 1007 inserted in the atomizing sleeve 1004;

an insulating ring 1008 sleeved inside the external electrode 1007; and an internal electrode 1009 inserted in the insulating ring 1008, where the air intake hole is arranged on the internal electrode 1009.

In this embodiment, the smoking switch is an airflow-sensitive switch 1010 configured to generate the trigger signal according to a smoking action of the user. Practically, the smoking switch may also be a button switch, which is not limited in this embodiment.

Specifically, when the user smokes through the mouthpiece cover 100, a pressure inside the electronic cigarette body is reduced, for the airflow-sensitive switch 1010 to correspondingly generate the trigger signal in response to the reduction of the pressure inside the electronic cigarette.

A microprocessor 1011 is electrically connected to the airflow-sensitive switch 1010.

In this embodiment, a first operation button may be provided on the electronic cigarette body, where the first operation button can control the battery 102 to supply power to the atomizer 101 and the electromagnetic switch according a pressing operation of the user.

More specifically, an input module is provided on the housing 602.

In this embodiment, the input module is a second operation button 1012 configured to generate the first operation instruction according to a push operation of the user.

That is, the user can select the target atomizer by means of the second operation button 1012. In this embodiment, the number of second operation buttons 1012 is equal to the number of atomizers 101, i.e. the second operation buttons have a one-to-one correspondence relationship with the atomizers 101. The user can select an atomizer 101 as the target atomizer by means of a second operation button 1012 corresponding to the atomizer 101.

Further, a touch screen may be provided on the electronic cigarette body, where the touch screen is configured to generate the first operation instruction according to a touch operation of the user.

Further, a voice smoking switch may be provided on the electronic cigarette body, where the voice smoking switch is configured to generate the first operation instruction according to a voice inputted by the user.

In a fourth embodiment, a control method based on the electronic cigarette according to the above embodiments is described in detail. With the control method described in this embodiment, the electronic cigarette can atomize cigarette liquids with different flavors, and increase the amount of smoke.

Figure 11:
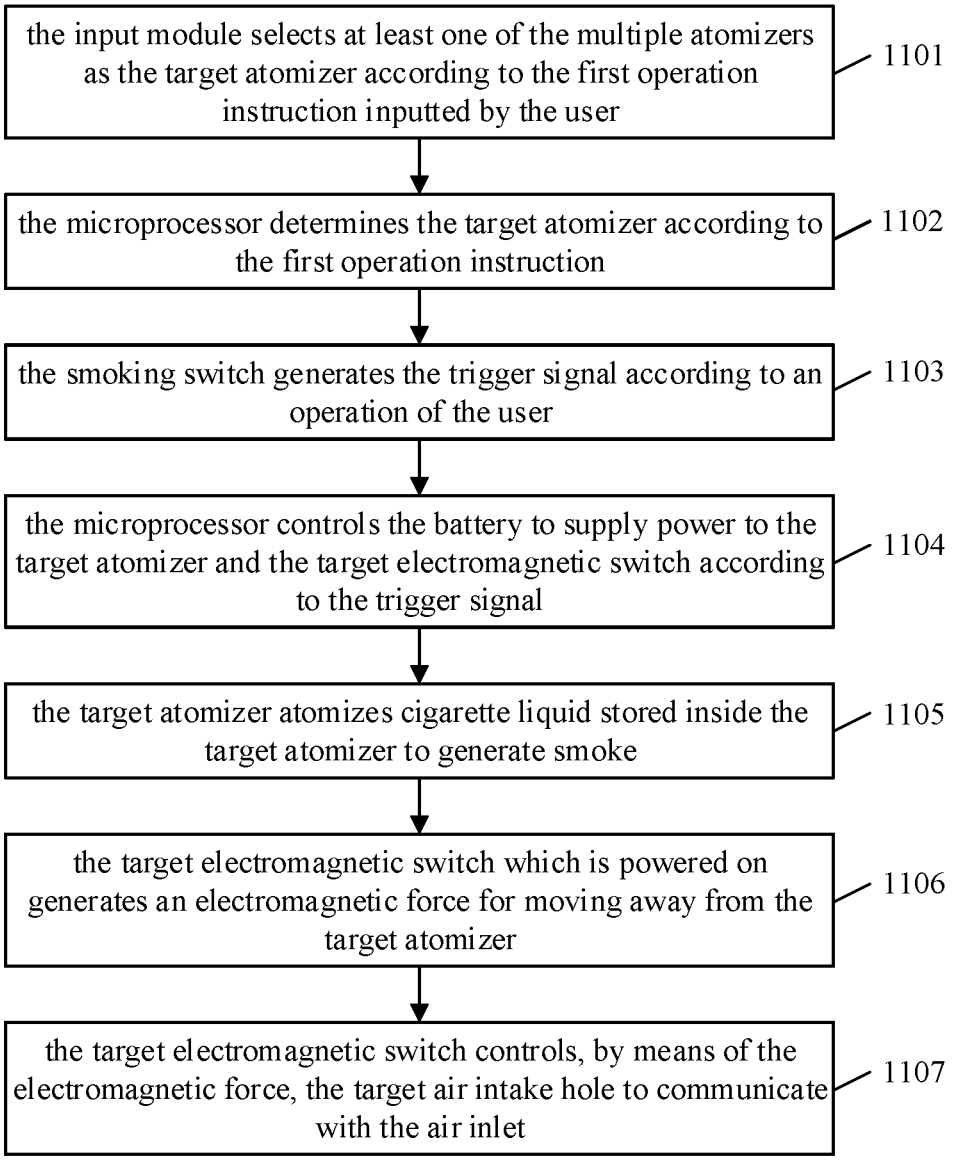
FIG. 11 is a flow chart showing steps of a control method according to a preferred embodiment of the invention.
Figure 12:
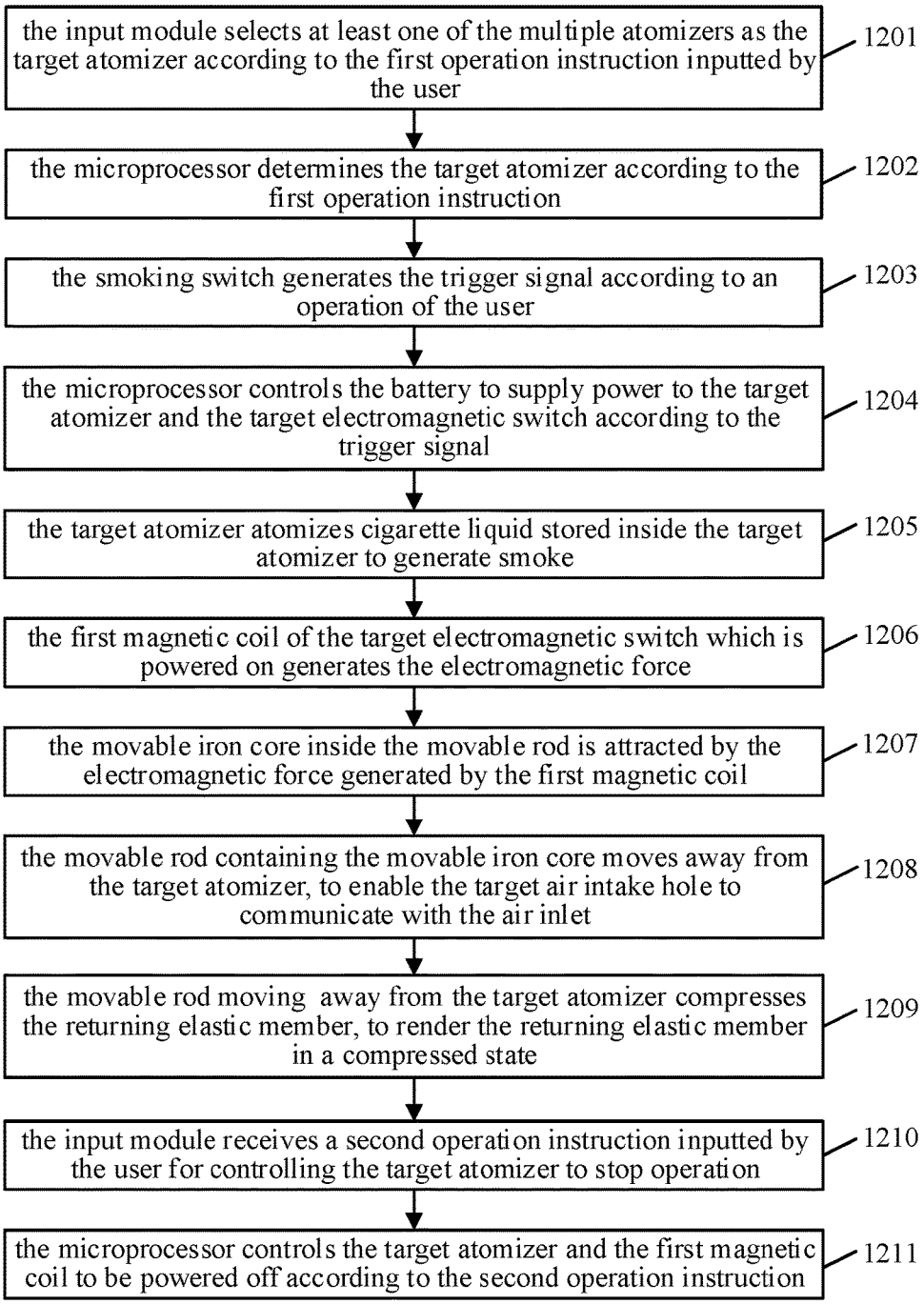
FIG. 12 is a flow chart showing steps of a control method according to another preferred embodiment of the invention.
Figure 13:
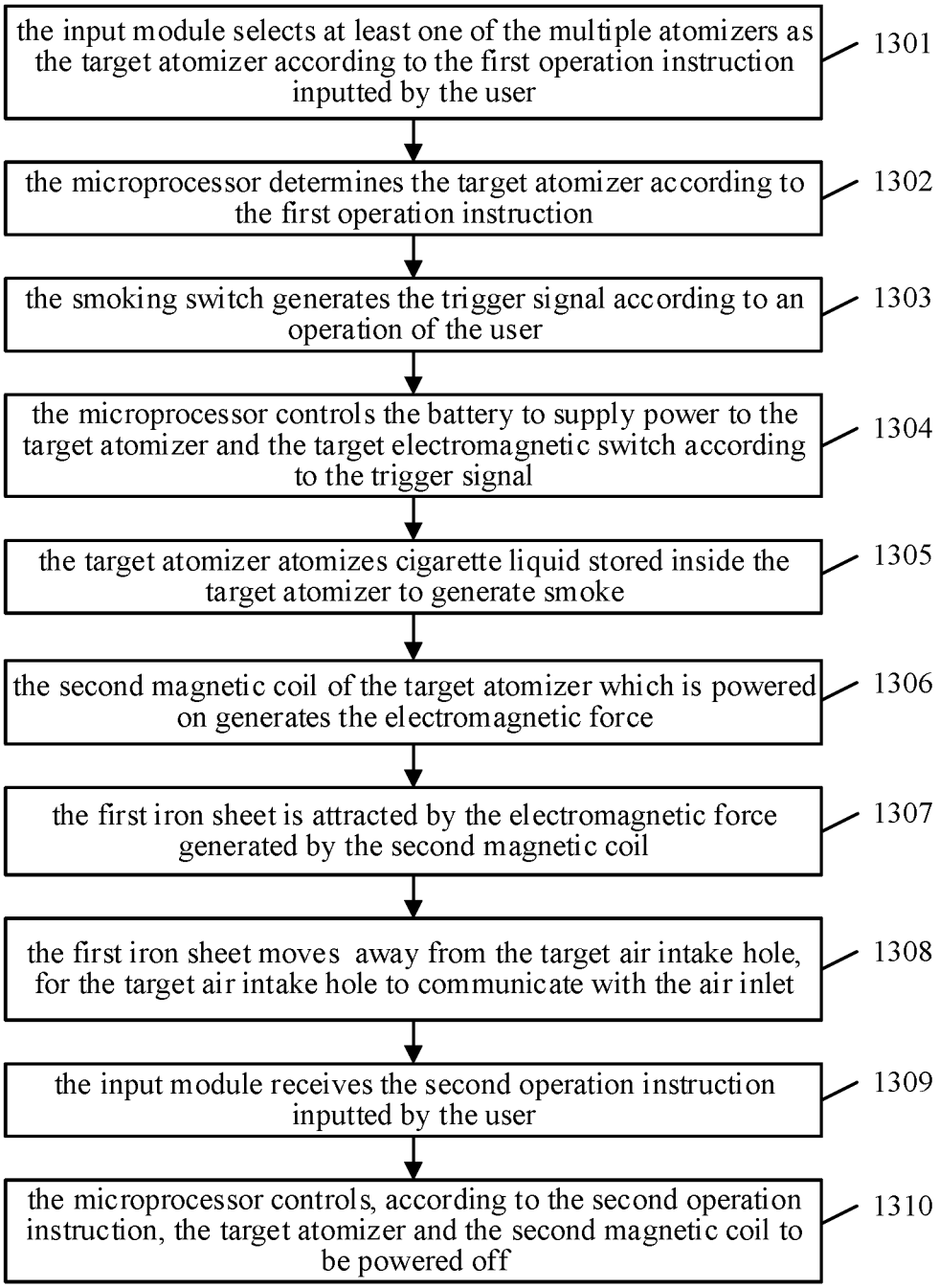
FIG. 13 is a flow chart showing steps of a control method according to another preferred embodiment of the invention.
Figure 14:
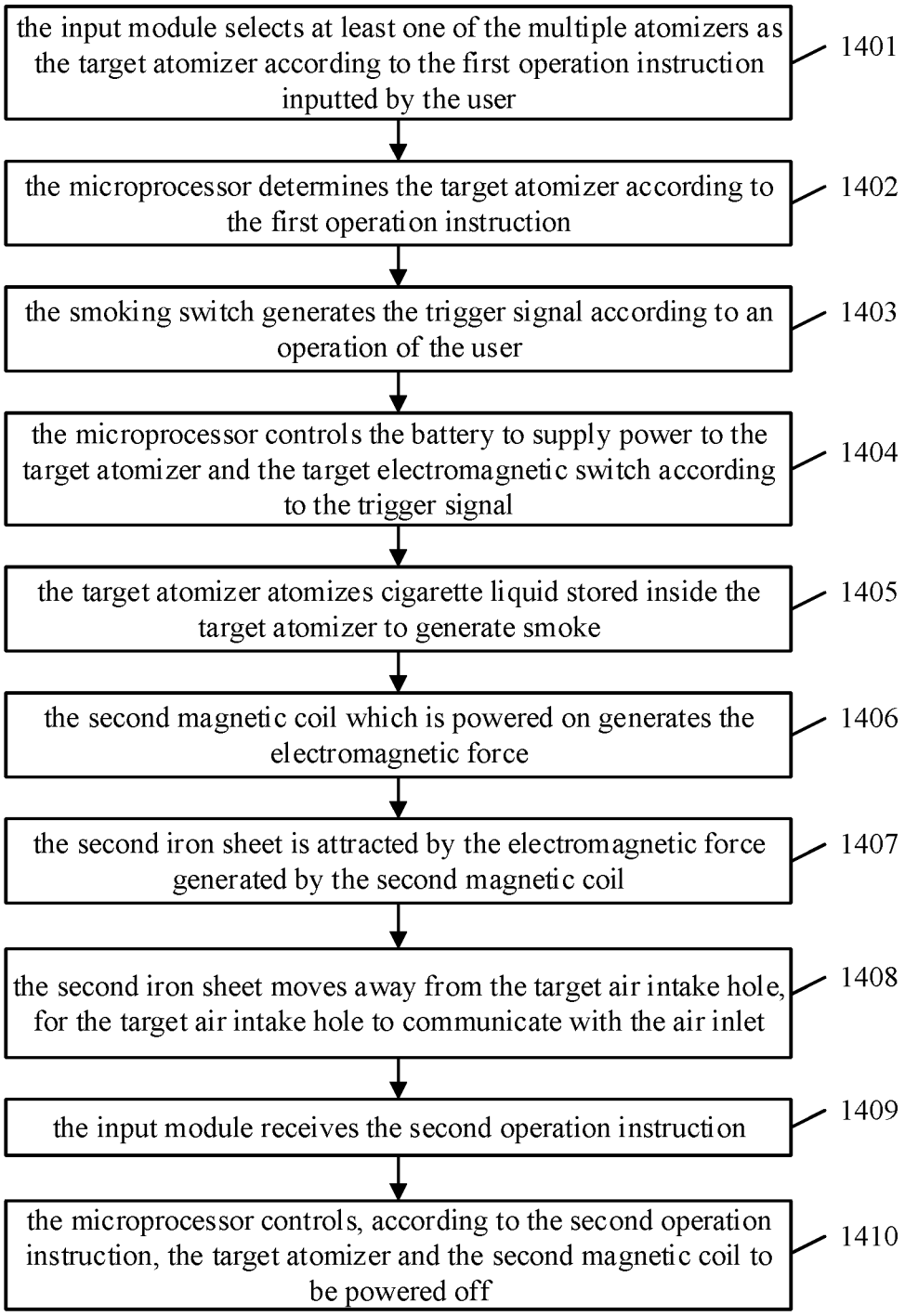
FIG. 14 is a flow chart showing steps of a control method according to another preferred embodiment of the invention.

Referring to FIG. 11, the control method includes the following steps 1101 to 1107.

In 1101, the input module selects at least one of the multiple atomizers as the target atomizer according to the first operation instruction inputted by the user.

In 1102, the microprocessor determines the target atomizer according to the first operation instruction.

In 1103, the smoking switch generates the trigger signal according to an operation of the user.

In 1104, the microprocessor controls the battery to supply power to the target atomizer and the target electromagnetic switch according to the trigger signal.

In 1105, the target atomizer atomizes cigarette liquid stored inside the target atomizer to generate smoke.

In 1106, the target electromagnetic switch which is powered on generates an electromagnetic force for moving away from the target atomizer.

In 1107, the target electromagnetic switch controls by means of the electromagnetic force the target air intake hole to communicate with the air inlet.

Reference can be made to the first to fourth embodiments for the specific structure of the electronic cigarette for implementing the control method described in this embodiment, which is not described in this embodiment.

In a fifth embodiment, the control method is described in further detail since the control method for the electronic cigarette to control the airflow to flow into only the target atomizer varies depending on the structure of the electronic cigarette.

In the following, a first control method is described. Reference can be made to the first configuration in the second embodiment for the specific structure of the electronic cigarette for implementing the first control method.

The first control method in this embodiment includes the following steps 1201 to 1211.

In 1201, the input module selects at least one of the multiple atomizers as the target atomizer according to the first operation instruction inputted by the user.

In 1202, the microprocessor determines the target atomizer according to the first operation instruction.

In 1203, the smoking switch generates the trigger signal according to an operation of the user.

In 1204, the microprocessor controls the battery to supply power to the target atomizer and the target electromagnetic switch according to the trigger signal.

In 1205, the target atomizer atomizes cigarette liquid stored inside the target atomizer to generate smoke.

The steps 1201 to 1205 in this embodiment are the same as the steps 1101 to 1105 in the fourth embodiment, which are thus not described in detail in this embodiment.

In 1206, the first magnetic coil of the target electromagnetic switch which is powered on generates the electromagnetic force.

In 1207, the movable iron core inside the movable rod is attracted by the electromagnetic force generated by the first magnetic coil.

In 1208, the movable rod containing the movable magnetic moves away from the target atomizer, to enable the target air intake hole to communicate with the air inlet.

In 1209, the movable rod moving away from the target atomizer compresses the returning elastic member, to render the recover elastic member in a compressed state.

In 1210, the input module receives a second operation instruction inputted by the user for controlling the target atomizer to stop operation.

Reference can be made to the third embodiment for the specific structure of the input module described in this embodiment. The input module can receive not only the first operation instruction inputted by the user but also the second operation instruction inputted by the user. The user controls the target atomizer which is operating to generate the smoke to stop operating by means of the second operation instruction.

In 1211, the microprocessor controls the target atomizer and the first magnetic coil to be powered off according to the second operation instruction.

Since the first magnetic coil is powered off, the returning elastic member in the compressed state springs back to control the movable rod to return to its original position to enable the abutting-against portion to abut against the air intake hole again.

In the following, a second control method is described. Reference can be made to the second configuration in the second embodiment for the specific structure of the electronic cigarette for implementing the second control method.

The second control method in this embodiment includes the following steps 1301 to 1310.

In 1301, the input module selects at least one of the multiple atomizers as the target atomizer according to the first operation instruction inputted by the user.

In 1302, the microprocessor determines the target atomizer according to the first operation instruction.

In 1303, the smoking switch generates the trigger signal according to an operation of the user.

In 1304, the microprocessor controls the battery to supply power to the target atomizer and the target electromagnetic switch according to the trigger signal.

In 1305, the target atomizer atomizes cigarette liquid stored inside the target atomizer to generate smoke.

The steps 1301 to 1305 in this embodiment are the same as the steps 1101 to 1105 in the fourth embodiment, which are thus description is not described in detail in this embodiment.

In 1306, the second magnetic coil of the target atomizer which is powered on generates the electromagnetic force.

In 1307, the first iron sheet is attracted by the electromagnetic force generated by the second magnetic coil.

In 1308, the first iron sheet moves away from the target air intake hole, for the target air intake hole to communicate with the air inlet.

In 1309, the input module receives the second operation instruction inputted by the user.

In 1310, the microprocessor controls, according to the second operation instruction, the target atomizer and the second magnetic coil to be powered off.

Since the second magnetic coil is powered off, the first iron sheet abuts against the air intake hole again under the action of an airflow inside the electronic cigarette body.

In the following, a third control method is described. Reference can be made to the third configuration in the third embodiment for the specific structure of the electronic cigarette for implementing the third control method.

The third control method in this embodiment includes the following steps 1401 to 1410.

In 1401, the input module selects at least one of the multiple atomizers as the target atomizer according to the first operation instruction inputted by the user.

In 1402, the microprocessor determines the target atomizer according to the first operation instruction.

In 1403, the smoking switch generates the trigger signal according to an operation of the user.

In 1404, the microprocessor controls the battery to supply power to the target atomizer and the target electromagnetic switch according to the trigger signal.

In 1405, the target atomizer atomizes cigarette liquid stored inside the target atomizer to generate smoke.

The steps 1401 to 1405 in this embodiment are the same as the steps 1101 to 1105 in the fourth embodiment, which are thus not described in detail in this embodiment.

In 1406, the second magnetic coil which is powered on generates the electromagnetic force.

In 1407, the second iron sheet is attracted by the electromagnetic force generated by the second magnetic coil.

In 1408, the second iron sheet moves away from the target air intake hole, for the target air intake hole to communicate with the air inlet.

In 1409, the input module receives the second operation instruction.

In 1410, the microprocessor controls, according to the second operation instruction, the target atomizer and the second magnetic coil to be powered off.

Since the second magnetic coil is powered off, the second iron sheet abuts against the air intake hole of the atomizer again because of an airflow inside the electronic cigarette body.

The technical solution according to the embodiments of the present disclosure will be described clearly and completely in conjunction with the drawings hereinafter. It is apparent that the described embodiments are only a few rather than all of the embodiments of the invention. Any other embodiments obtained by those skilled in the art based on the embodiments in the present disclosure without any creative work fall in the scope of the present disclosure.

The embodiments in this specification are described in a progressive manner, each of which emphasizes the differences from the others, and reference can be made to each other for the same or similar parts among the embodiments.

With the above descriptions of the disclosed embodiments, the skilled in the art may implement or use the present disclosure. Various modifications to the embodiments are apparent to those skilled in the art. The general principle defined herein can be implemented in other embodiments without departing from the spirit or scope of the present disclosure. Therefore, the present disclosure shall not be limited to the embodiments disclosed herein, but has the widest scope in conformity with the principle and the novel features disclosed herein.

The invention claimed is:

1. An electronic cigarette, comprising:

an electronic cigarette body;

a plurality of atomizers configured to atomize cigarette liquid, a battery to supply power to the plurality of atomizers, a smoking switch configured to generate a trigger signal according to an operation of a user, an input module configured to receive a first operation instruction from the user to select a target atomizer, and a microprocessor electronically connected to the input module, the smoking switch, the battery and the atomizers, all of which are arranged inside the electric cigarette body;

a plurality of electromagnetic switches electronically connected to the microprocessor, wherein the plurality of electromagnetic switches are arranged in a one-to-one correspondence relationship with air intake holes of the plurality of atomizer and are configured to open or close respective air intake holes, for the microprocessor to control the batter to supply power to the target atomizer and a target electromagnetic switch corresponding to the target atomizer according to the trigger signal, to enable a target air intake hole of the target atomizer to communicate with an air inlet on the electronic cigarette body; and wherein each of the plurality of electromagnetic switches comprises:

a fixing sleeve;

a first through hole provided at an end of the fixing sleeve close to an atomizer;

an end cover provided at and matching with an end of the fixing sleeve away from the atomizer;

a movable rod provided inside the fixing sleeve and extended towards the atomizer through the first through hole to form an abutting-against portion arranged opposite to and abutting against an air intake hole of the atomizer;

a movable iron core provided within an end of the movable rod away from the atomizer;

a helical first magnetic coil wound around an outer circumference of the fixing sleeve, wherein the first magnetic coil, when powered on, generates an electromagnetic force to attract the movable iron core, to enable the air intake hole to communicate with the air inlet;

a retaining ring formed by a circumferential side of the movable rod close to the first through hole extending in a radial direction of the movable rod, wherein a diameter of the retaining ring is greater than a diameter of the first through hole; and a returning elastic member provided around the movable rod and retained between the retaining ring and the end cover, wherein the returning elastic member controls the abutting-against portion to abut against the air intake hole when the first magnetic coil is powered off.

2. The electronic cigarette according to claim 1, wherein the returning elastic member is a returning spring.

3. An electronic cigarette, comprising:

an electronic cigarette body;

a plurality of atomizers configured to atomize cigarette liquid, a battery to supply power to the plurality of atomizers, a smoking switch configured to generate a trigger signal according to an operation of a user, an input module configured to receive a first operation instruction from the user to select a target atomizer, and a microprocessor electronically connected to the input module, the smoking switch, the battery and the atomizers, all of which are arranged inside the electric cigarette body;

a plurality of electromagnetic switches electronically connected to the microprocessor, wherein the plurality of electromagnetic switches are arranged in a one-to-one correspondence relationship with air intake holes of the plurality of atomizer and are configured to open or close respective air intake holes, for the microprocessor to control the batter to supply power to the target atomizer and a target electromagnetic switch corresponding to the target atomizer according to the trigger signal, to enable a target air intake hole of the target atomizer to communicate with an air inlet on the electronic cigarette body; and wherein each of the plurality of electromagnetic switches comprises:

a magnetic core; and a second magnetic coil wound around an outer circumference of the magnetic core, wherein the second magnetic coil, when powered on, generates an electromagnetic force for moving away from the atomizer.

4. The electronic cigarette according to claim 3, wherein, fixation bases are detachably connected to the plurality of atomizer respectively;

second through holes corresponding to the air intake holes of the plurality of atomizers in position are provided on the fixation bases;

a first check valve is fixedly provided inside each of the second through holes;

a first iron sheet is provided on a valve gate of the first check valve, wherein the first iron sheet abuts against the air intake hole of the atomizer under action of an airflow inside the electronic cigarette body when the second magnetic coil is powered off, and the first iron sheet is attracted by the magnetic force generated by the second magnetic coil and moves away from the target air intake hole when the second magnetic coil is powered on, to enable the target air intake hole to communicate with the air inlet.

5. The electronic cigarette according to claim 3, wherein, a second check valve is provided matching with each of the air intake holes of the plurality of atomizers; and a second iron sheet is provided on a valve gate of the second check valve, wherein the second iron sheet abuts against an air intake hole of a corresponding atomizer under the action of an airflow inside the electronic cigarette body when the second magnetic coil is powered off, and the second iron sheet is attracted by the electromagnetic force generated by the second magnetic coil and moves away from the target air intake hole when the second magnetic coil is powered on, to enable the target air intake hole to communicate with the air inlet.

6. The electronic cigarette according to claim 1, further comprising:

a mounting base, wherein the plurality of atomizer are removably inserted in the mounting base for the plurality of atomizers to be detachably connected to the electronic cigarette body.

7. The electronic cigarette according to claim 6, wherein each of the plurality of atomizers comprises:

an atomizing sleeve;

an electric heating assembly provided inside the atomizing sleeve and configured to atomize cigarette liquid;

a cigarette liquid storage assembly provided inside the atomizing sleeve and configured to store the cigarette liquid and deliver the cigarette liquid to the electric heating assembly;

an external electrode inserted in the atomizing sleeve;

an insulating ring sleeved inside the external electrode; and an internal electrode inserted in the insulating ring, wherein the air intake hole is arranged on the internal electrode.

8. The electronic cigarette according to claim 1, wherein the smoking switch is an airflow-sensitive switch configured to generate the trigger signal according to a smoking action of the user.

9. The electronic cigarette according to claim 1, wherein the input module comprises:

a second operation button configured to generate the first operation instruction according to a pressing operation of the user;

a touch screen configured to generate the first operation instruction according to a touch operation of the user; and/or a voice smoking switch configured to generate the first operation instruction according to a voice inputted by the user.

10. A control method based on the electronic cigarette according to claim 1, comprising:

selecting, by the input module, at least one of the plurality of atomizer as the target atomizer according to the first operation instruction inputted by the user;

determining, by the microprocessor, the target atomizer according to the first operation instruction;

generating, by the smoking switch, the trigger signal according to an operation of the user;

controlling, by the microprocessor, the battery to supply power to the target atomizer and the target electromagnetic switch according to the trigger signal;

atomizing, by the target atomizer, cigarette liquid stored inside the target atomizer to generate smoke;

generating, by the target electromagnetic switch which is powered on, an electromagnetic force for moving away from the target atomizer; and controlling, by the target electromagnetic switch by means of the electromagnetic force, the target air intake hole to communicate with the air inlet.

11. The control method according to claim 10, wherein, the generating, by the target electromagnetic switch which is powered on, an electromagnetic force for moving away from the target atomizer comprises generating, by the first magnetic coil of the target electromagnetic switch which is powered on, the electromagnetic force; and the controlling, by the target electromagnetic switch by means of the electromagnetic force, the target air intake hole to communicate with the air inlet comprises:

attracting the movable iron core inside the movable rod by the electromagnetic force generated by the first magnetic coil, the movable rod containing the movable iron core moving away from the target atomizer, to enable the target air intake hole to communicate with the air inlet, and compressing, by the movable rod moving away from the target atomizer, the returning elastic member, to render the returning elastic member in a compressed state.

12. The control method according to claim 11, after the compressing, by the movable rod moving away from the target atomizer, the returning elastic member, further comprising:

receiving, by the input module, a second operation instruction inputted by the user for controlling the target atomizer to stop operation; and controlling, by the microprocessor, the target atomizer and the first magnetic coil to be powered off according to the second operation instruction, for the returning elastic member in the compressed state to spring back to control the movable rod to return to its original position, to enable the abutting-against portion to abut against the air intake hole again.

13. The electronic cigarette according to claim 3, further comprising:

a mounting base, wherein the plurality of atomizer are removably inserted in the mounting base for the plurality of atomizers to be detachably connected to the electronic cigarette body.

14. A control method based on the electronic cigarette according to claim 3, comprising:

selecting, by the input module, at least one of the plurality of atomizer as the target atomizer according to the first operation instruction inputted by the user;

determining, by the microprocessor, the target atomizer according to the first operation instruction;

generating, by the smoking switch, the trigger signal according to an operation of the user;

controlling, by the microprocessor, the battery to supply power to the target atomizer and the target electromagnetic switch according to the trigger signal;

atomizing, by the target atomizer, cigarette liquid stored inside the target atomizer to generate smoke;

generating, by the target electromagnetic switch which is powered on, an electromagnetic force for moving away from the target atomizer; and controlling, by the target electromagnetic switch by means of the electromagnetic force, the target air intake hole to communicate with the air inlet.

15. The electronic cigarette according to claim 13, wherein each of the plurality of atomizers comprises:

an atomizing sleeve;

an electric heating assembly provided inside the atomizing sleeve and configured to atomize cigarette liquid;

a cigarette liquid storage assembly provided inside the atomizing sleeve and configured to store the cigarette liquid and deliver the cigarette liquid to the electric heating assembly;

an external electrode inserted in the atomizing sleeve;

an insulating ring sleeved inside the external electrode; and an internal electrode inserted in the insulating ring, wherein the air intake hole is arranged on the internal electrode.

16. The electronic cigarette according to claim 3, wherein the smoking switch is an airflow-sensitive switch configured to generate the trigger signal according to a smoking action of the user.

17. The electronic cigarette according to claim 3, wherein the input module comprises:

a second operation button configured to generate the first operation instruction according to a pressing operation of the user;

a touch screen configured to generate the first operation instruction according to a touch operation of the user; and/or a voice smoking switch configured to generate the first operation instruction according to a voice inputted by the user.

18. The control method according to claim 14, wherein the generating, by the target electromagnetic switch which is powered on, an electromagnetic force for moving away from the target atomizer comprises generating, by the second magnetic coil of the target atomizer which is powered on, the electromagnetic force; and the controlling, by the target electromagnetic switch by means of the electromagnetic force, the target air intake hole to communicate with the air inlet comprises:

attracting a first iron sheet by the electromagnetic force generated by the second magnetic coil, and the first iron sheet moving away from the target air intake hole, for the target air intake hole to communicate with the air inlet.

19. The control method according to claim 18, after the first iron sheet moving away from the target air intake hole, further comprising:

receiving, by the input module, a second operation instruction inputted by the user; and controlling, by the microprocessor according to the second operation instruction, the target atomizer and the second magnetic coil to be powered off, for the first iron sheet to abut against the air intake hole again under the action of an airflow inside the electronic cigarette body.

20. The control method according to claim 14, wherein the generating, by the target electromagnetic switch which is powered on, an electromagnetic force for moving away from the target atomizer comprises generating, by the second magnetic coil which is powered on, the electromagnetic force; and the controlling, by the target electromagnetic switch by means of the electromagnetic force, the target air intake hole to communicate with the air inlet comprises:

attracting a second iron sheet by the electromagnetic force generated by the second magnetic coil, and the second iron sheet moving away from the target air intake hole, for the target air intake hole to communicate with the air inlet.

21. The control method according to claim 20, after the second iron sheet moving away from the target air intake hole, further comprising:

receiving, by the input module, a second operation instruction inputted by the user; and controlling, by the microprocessor according to the second operation instruction, the target atomizer and the second magnetic coil to be powered off, for the second iron sheet to abut against the air intake hole of the atomizer again under the action of an airflow inside the electronic cigarette body.

* * * * *